US011904250B2

(12) United States Patent
Mosley

(10) Patent No.: US 11,904,250 B2
(45) Date of Patent: Feb. 20, 2024

(54) APPARATUS FOR INVOKING A FREE-FALL EXPERIENCE

(71) Applicant: Jimmy Doyle Mosley, Greenville, MS (US)

(72) Inventor: Jimmy Doyle Mosley, Greenville, MS (US)

( * ) Notice: Subject to any disclaimer, the term of this patent is extended or adjusted under 35 U.S.C. 154(b) by 49 days.

(21) Appl. No.: 17/556,679

(22) Filed: Dec. 20, 2021

(65) Prior Publication Data

US 2022/0193560 A1 Jun. 23, 2022

Related U.S. Application Data

(60) Provisional application No. 63/128,329, filed on Dec. 21, 2020.

(51) Int. Cl.
*A63G 31/00* (2006.01)
*A63G 31/10* (2006.01)

(52) U.S. Cl.
CPC ..... *A63G 31/00* (2013.01); *A63G 2031/002* (2013.01)

(58) Field of Classification Search
CPC ..... A63G 2031/002; A63G 2031/005; A63G 31/10; A63G 1/44
USPC ..... 472/2, 50
See application file for complete search history.

(56) References Cited

U.S. PATENT DOCUMENTS 628,260 A 7/1899 Alz
2,229,201 A 1/1941 Williford et al.
4,997,060 A 3/1991 Sassak
5,417,615 A 5/1995 Beard
5,583,326 A 12/1996 Sors
5,597,358 A 1/1997 Marcu
5,628,690 A 5/1997 Spieldiener et al.
5,632,686 A 5/1997 Checketts
5,704,841 A 1/1998 Cheketts
5,893,802 A 4/1999 Böhme
6,001,022 A 12/1999 Spieldiener et al.
6,126,550 A 10/2000 Moser et al.
6,315,674 B1 11/2001 Slade et al.
6,342,017 B1 1/2002 Kockelman
8,122,999 B2 2/2012 Guillermety
8,690,694 B2 4/2014 Barber
8,695,759 B1 4/2014 Michael
2002/0103033 A1* 8/2002 Stengel ..... A63G 31/08 472/131
2009/0139797 A1 6/2009 Rastegar et al.
(Continued)

FOREIGN PATENT DOCUMENTS

WO 2000078423 12/2000
WO 2016072708 5/2016

*Primary Examiner* — Kien T Nguyen
(74) *Attorney, Agent, or Firm* — John Rizvi; John Rizvi, P.A—The Patent Professor®

(57) ABSTRACT

A free-fall apparatus comprising a vertical structure that houses and supports a lifting assembly that includes a wearable harness, a support member, anchored pulleys, a lifting cable, and a lifting device. The vertical structure also houses and supports a braking assembly that includes a pair of cylinders, pistons, anchored pulleys, and braking cables. The amusement ride's unique design provides end-users with selective control of their entertainment experience by allowing each end-user the ability to decide when to engage the release mechanism that induces the safe yet exhilarating free-fall experience.

20 Claims, 6 Drawing Sheets

(56) References Cited

U.S. PATENT DOCUMENTS

| | | | | |
|---|---|---|---|---|
| 2014/0150685 | A1 | 6/2014 | Cheketts | |
| 2018/0036644 | A1* | 2/2018 | Wright | A63G 21/20 |
| 2019/0366141 | A1* | 12/2019 | Cylvick | A63B 21/4011 |

* cited by examiner

APPARATUS FOR INVOKING A FREE-FALL EXPERIENCE

CROSS-REFERENCE TO RELATED APPLICATIONS

This application claims the benefit of U.S. Provisional Patent Application Ser. No. 63/128,329, filed on Dec. 21, 2020, which is incorporated herein in its entirety.

FIELD OF THE INVENTION

The present invention generally relates to amusement rides, and more particularly, to an amusement ride that provides end-users with selective control of their entertainment experience by allowing each end-user the ability to decide when to engage a mechanism that induces a free-fall experience.

BACKGROUND OF THE INVENTION

There is substantial diversity when it comes to the different components of entertainment. Entertainment can be utilized by the individual to provide an avenue for heightened senses that surpass daily physiological levels. For example, a tragic theatrical performance may draw heightened emotional responses from the audience. Playing chess forces the players to practice their strategic thinking skills in a competitive manner, engulfing each in intense focus. Exercising will permit an individual to push themselves beyond yesterday's limit and ultimately lead to a feeling of defeat or pride, depending on the outcome. However, a theory of any form of entertainment which unites these seemingly disparate examples stems from the desire for individuals to experience an ulterior world. Immersion in a fictitious world is how the entertainment industry thrives. Individuals are willing to spend a substantial amount money in order to be temporarily deceived by the entertainment industry into believing they are experiencing a different world or feeling foreign to them.

As is well documented, the entertainment industry does not rely solely on theatrical performances, competitive games, or exercise to make a profit. It relies on a host of other elements—from inexpensive books, figurines, sports, and movies, to expensive luxuries like cruise ships, theme parks, casinos, and concerts. For example, according to data from the American Gaming Association, the commercial casino industry generated $9.7 billion in gaming taxes in 2018. This number does not account for the billions more in sales, income, and other taxes that benefit communities. Another form of highly enticing and profitable entertainment is amusement parks, and its history explains the trends in entertainment preference by the public.

Amusement parks with mechanical rides were only realized in the 1870s due to the lack of technological advancement. According to the National Amusement Park Historical Association, the completion of the first railroad to Coney Island, NY made its amusement park rise in popularity. It contained forms of entertainment in different acts, fortune tellers, a wide variety of games, and small mechanical carousels. The carousels exemplified the first moment individuals could experience the thrill of a ride, despite it leaning closer to children entertainment than for adults. However, due to the success of the carousel, mechanical rides such as small-scale roller coasters and Ferris wheels were quickly developed and adored by the public. The success of this type of entertainment relied on its ability to provide an immersive and thrilling experience to the individual, a concept that became more extreme as time went on.

According to Statista, revenue of The Walt Disney Company parks and resorts in 2009 amounted to 10.76 billion US dollars. Nearly a decade later in 2018, its revenue increased to 20.29 billion US dollars. Not only are amusement parks becoming more and more popular as its rides become more immersive and advanced, but the kinds of rides that attract the most attention from visitors are those that result in a thrilling adrenaline boost, like roller coasters or free-fall rides. The free-fall rides found in amusement parks usually follow a set pattern where the rider is lifted to a certain height and either released to be caught on a safety net or accelerated downwards if machine controlled. This proves too intimidating for some park visitors, leading to the free-fall rides earning less visitors in relation to other thrilling attractions. There is potential for free-fall rides to be popular as they, much like others but to a greater extent, have the ability to temporarily remove the individual from reality in a thrilling manner.

Accordingly, an unmet need for amusement parks to increase their revenue by taking advantage of the latent potential of free-fall rides exists. A free-fall ride where the individual gauges when their drop will take place guarantees to be a more reasonable and attractive form of entertainment with a wider appeal than those that do not support this feature. Moreover, the free-fall device in an alternative form could be used as a training mechanism or the like for those needing training in free-fall exercises.

SUMMARY OF THE INVENTION

The present invention is directed to an amusement ride that provides an end-user with control of their entertainment experience by allowing each end-user the ability to decide when to induce a free-fall experience. Particularly, an amusement ride that provides a free-fall ride experience that allows end-users to limit the height from where they might drop, placing a guarantee that the end-user comfort level will not exceed what is reasonably acceptable to the person, thereby making the amusement ride a more attractive form of entertainment with a wider appeal than those that do not support a similar feature.

Introducing a first embodiment of the invention, the present invention consists of an apparatus for experiencing a free-fall effect, comprising, a vertical structure including a plurality of structural members to provide structural integrity, wherein the vertical structure is securable to a level surface;

a lifting assembly, comprising a wearable body harness for securing an end-user to the lifting assembly, a support member positionable normal to the relative vertical position of the end-user, the support member including a pair of anchors at opposite ends of the support member about a bottom end portion, and a plurality of spaced-apart anchor members about a top portion, a plurality of harness webbings, each webbing including a first end removably attachable to a portion of the body harness and a second end securably attached to an anchor on the bottom portion of the support member for securing the wearable body harness to the longitudinal member of the lifting assembly, a lift assembly confined within the vertical structure for positioning an end-user in a free-fall position, the lift assembly including a lifting device securable to the level surface, a plurality of anchored pulleys anchored to an upper portion of the vertical structure, and at least one lifting cable extending from the lifting device through the anchored pulleys and selectively engageable to an anchor on the top portion of the support member of the lifting assembly, wherein the lifting device is capable of winding the lifting cable when attached to the support member of the lifting assembly to effectively position the end-user in the free-fall position, wherein the free-fall position is any distance above the level surface; and a braking assembly confined within the vertical structure for stopping the end-user when falling from the free-fall position before the end-user reaches the level surface, the braking assembly, comprising at least one cylinder body extending vertically within the vertical structure having an open end and a closed-end that includes an opening, a support frame securable to the level surface and supporting the cylinder body, at least one weighted member slidable within an interior of the cylinder body and the support frame, a plurality of pulleys anchored to the vertical structure, and at least one braking cable attachable to and extending from the weighted member through the plurality of pulleys and securable to an anchor on the top portion of the support member of the lifting assembly.

In another aspect, the lifting assembly may include a releasable mechanism selectively engageable by an end-user, the releasable mechanism disengaging the lifting cable from the anchor the lifting cable engages on the top portion of the support member of the lifting assembly to initiate a free-fall experience.

In another aspect, the lift mechanism may comprise an electrical motor, such as a winch.

In another aspect, the cylinder body may include a pressure zone that includes a plurality of spaced-apart apertures about a bottom portion of the cylinder body proximate to where the support frame attaches to the cylinder body. The apertures help to build pressure inside of the cylinder gradually as the weighted member or piston passes each aperture while moving upwardly within the cylinder body. The cylinder body also includes a compression zone that follows the pressure zone.

In another aspect, the free-fall amusement ride may be configured to allow multiple end-users to ride experience the free-fall effects provided by the instant invention. Each end-user may independently control when to engage the release mechanism to initiate their free-fall, controlling their own free-fall position.

In another aspect, the weighted members or piston is part of an airflow system that includes a plate valve that can open or close, depending on the direction of air flow. As air is allowed to flow through the piston to the plate valve when the piston is ascending, the plate valve is in a closed-position to create pressure within the cylinder body. When the piston is rapidly descending, the plate valve is in an open-position to prevent the creation of an unwanted vacuum.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
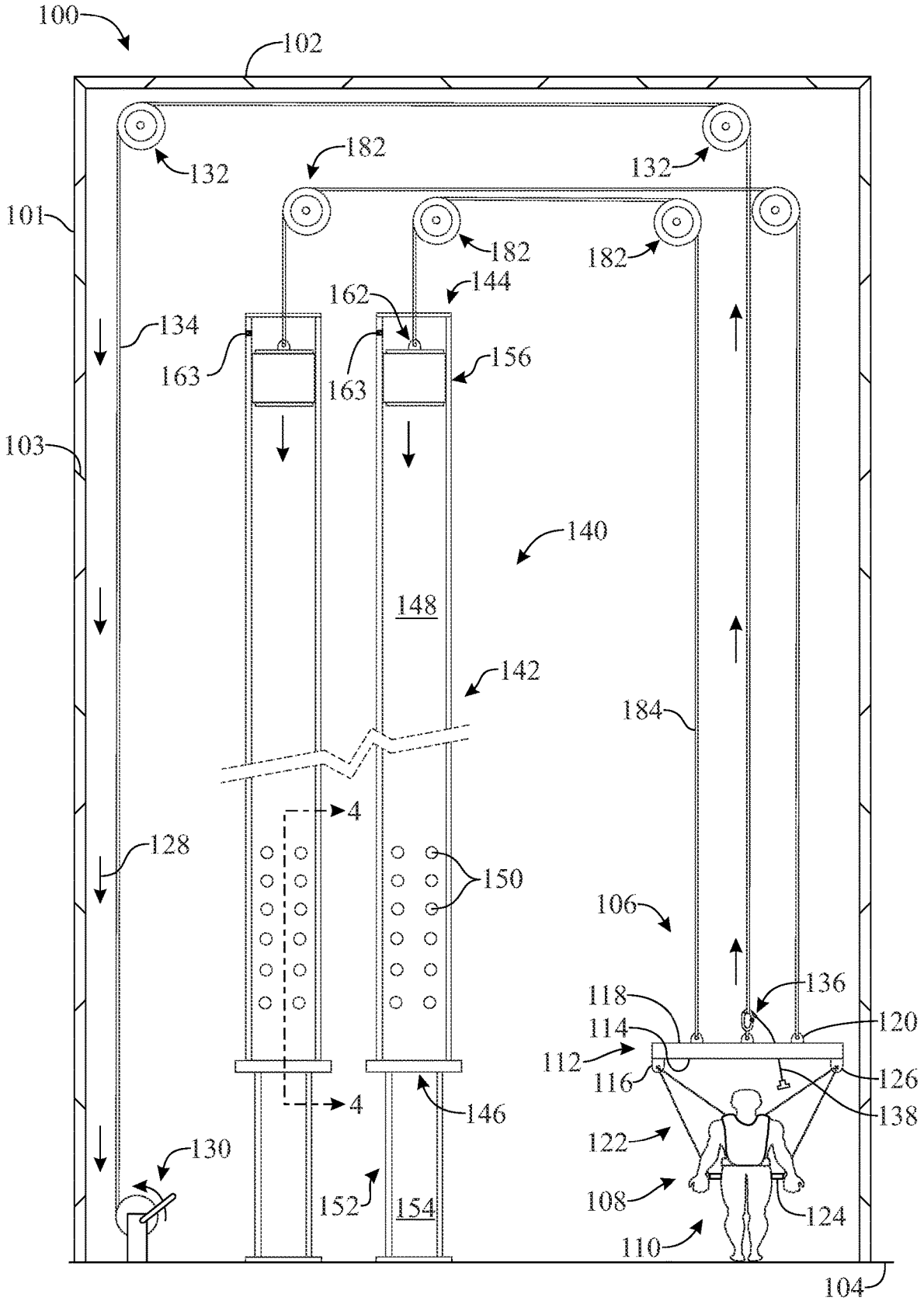
FIG. 1 presents a front elevation view showing a first embodiment of the free-fall amusement ride of the present invention.
Figure 2:
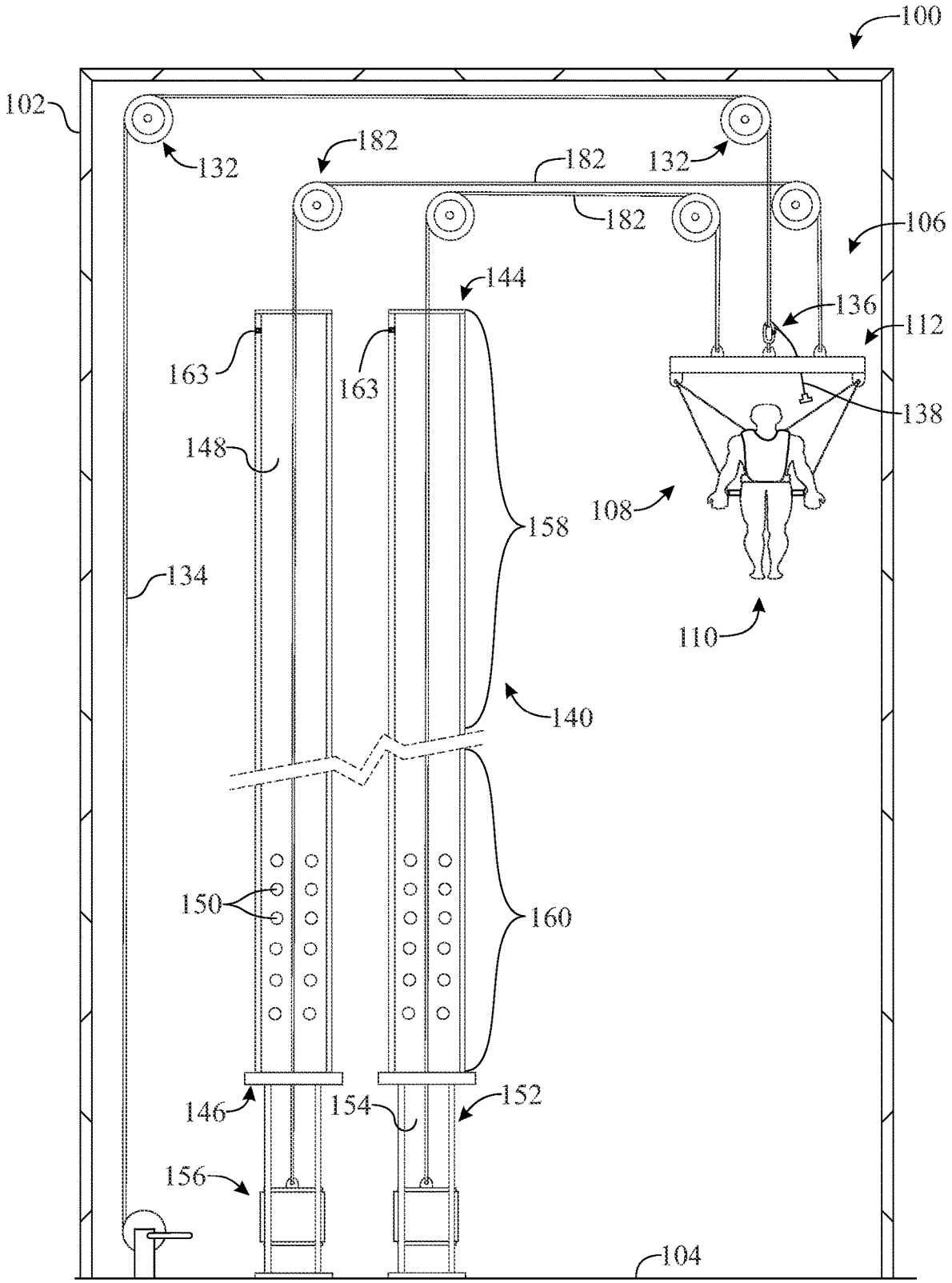
FIG. 2 presents a front elevation view of the first embodiment of the free-fall amusement ride with the end-user being hoisted to a maximum height before engaging the release mechanism to induce the free-fall experience.
Figure 3:
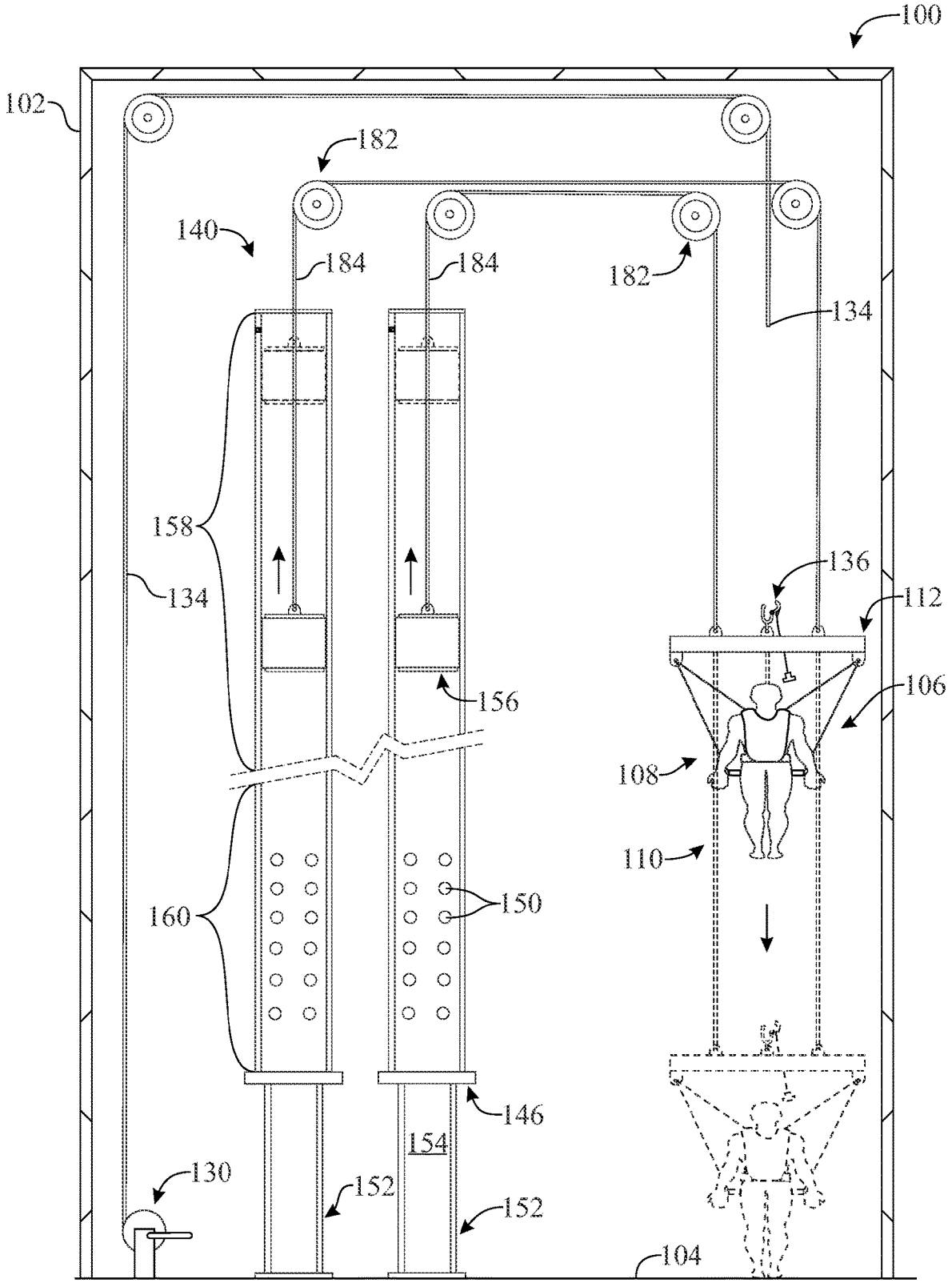
FIG. 3 presents a front elevation view of the first embodiment of the free-fall amusement ride with the end-user in a free-fall from a maximum height, and the braking system is actively slowing him down as the end-user moves closer to the ground surface.

Referring initially to FIGS. 1 through 3, a free-fall apparatus that can be utilized as an amusement ride (the apparatus referred to hereinafter as the "amusement ride") is generally shown as reference number 100. As shown in the accompanying drawings, the amusement ride 100 generally comprises a vertical structure 102, a lifting assembly 106, and a braking assembly 140, together forming a thrilling, safe, and unique free-fall experience amusement ride for an end-user 110. The vertical structure 102 of the amusement ride 100, as shown in the accompanying figures, may include a vertically erect structure comprising a plurality of elongated members 101 that includes a plurality of cross-braces 103 to provide stability and structural integrity to the vertical structure 102. In one exemplary embodiment, the material used to construct the vertical structure 102 may include any form of hardenable metal, mild-hardenable metal, aluminum alloys, or fiberglass that gives the structure the strength and the required flexibility to sustain the forces and strains felt on the structure during daily usage. For example, the vertical structure 102, in one exemplary embodiment, may include stainless steel metal comprising any valid combination of steel and chromium, nickel, aluminum, molybdenum, or carbon. In one exemplary embodiment, the vertical structure 102 of the amusement ride 100 is secured to a level ground surface 104 through conventional securement means. Alternatively, the vertical structure may be secured to a level surface that is movable. For example, the structure may be secured to a platform device that includes transportation wheels. Accordingly, the vertical device may be secured to any surface so long as the surface is level and can support the weight of the structure without caving or tipping over.

As shown in FIGS. 1 through 3, the vertical structure 102 provides a structural casing with an internal void for housing the lifting assembly 106 and the braking assembly 140 of the amusement ride 100. The lifting assembly 106 of the amusement ride 100 may generally comprise a harness 108, a support member 112, a plurality of anchored pulleys 132, a lifting cable 134, and a lifting device 130. More specifically, the wearable harness 108 of the lifting assembly 106 may comprise a one-point harness, a three-point harness, a vest-type harness, a parachute or full-body harness, or a seat-type harness. The wearable harness may include multiple anchor points that are selectively attachable via a carabiner or any the like to a webbing 122, as shown in the accompanying figures. Namely, a first end 124 of the webbing 122 is selectively coupled to the wearable harness 108 worn by the end-user, and at a second end 126 the webbing is securely coupled to an anchor 116 located about a bottom portion 114 of the longitudinal member. In some instances, the second end 126 of the webbing is not secured but instead threaded through the anchor 116 and stretched back toward the end-user 110 and securely coupled to an attachment point on the wearable harness 108.

The support member 112 of the lifting assembly 106 also includes a plurality of anchors 120 about the top portion 118 of support member 112. At least one of the anchors 120 on the support member 112 are used to couple the lifting cable 134 via a release mechanism 136 that includes a release chord 138 to the member itself. As seen in FIGS. 1 through 3, the lifting cable 134 of the lifting assembly 106 on one end is secured to the lifting device 130. The lifting device 130 in one exemplary embodiment may include a mechanical or electrical device that is capable of winding up the lifting cable 134 while the cable is under immense tension to lift the end-user. In some embodiments, the lifting device 130 may comprise a mechanical winch.

In a preferred embodiment, however, the lifting device comprises an electrically operated winch that includes a drum or spool where the lifting cable winds on. To prevent unwanted movement of the lifting device 130, the device is secured to the level surface 104, where the vertical structure is secured. As mentioned above, the level surface 104 may either be the ground surface having a concrete foundation or a movable foundation with wheels. The lifting cable 134 of the lifting assembly 106 extends from the lifting device 130 upwardly toward a first pulley 132 anchored to the vertical structure 102, then extends laterally toward at least a second pulley 132, positioned just below the support member 112 and adjacent the first pulley, and then downwardly until reaching the support member 112. The cable 134 is coupled to the support member 112 via the release mechanism 136, as seen in FIG. 1. As is well understood, the greater the number of pulleys used within a system, the effort needed or, in this case, the power required by the lifting device 130 to lift the end-user and the components holding the end-user, such as support member 112, weight of the cable 134, is reduced. Accordingly, one will appreciate that the number of at least two pulleys used in the drawings are exemplary and should not be considered limiting.

Within the internal space provided by the vertical structure 102, is the braking system 140 of the amusement ride 100. The braking system 140 of the amusement ride 100 generally comprises a pair of cylinders 142, a support frame 152, weighted members or pistons 156, a plurality of anchored pulleys 182, and at least a pair of braking cables 184. As is more specifically shown in FIGS. 1 and 4 through 6, the cylinders 142 of the braking assembly 140 include an internal passageway 148 wherein the piston 156 may slide about. Each cylinder in the braking system 140 includes a closed top 144 with an opening for receiving an end of the braking cable 184. The opening on the closed top 144 of the cylinder is sized to allow frictionless movement of the braking cable 184, yet small enough to prevent an undesired amount of air from escaping from the top portion of the cylinder. The braking cable 184 is securely coupled to a top portion of the piston 156 through a coupling device 162. Unlike the top of the cylinder, which is closed, the bottom portion of each cylinder 142 includes an open-end 146. The braking system 142 of the amusement ride 100 includes a pair of support frames 152 that hold each respective cylinder 142 in an upright, vertical position. The support frames 152, as shown in the accompanying figures, are attached or otherwise secured to the open-end 146 of cylinder 142. The support frame 152 also includes a passageway 154 generally dimensioned substantially the same as the passageway 148 offered by the cylinder 142, allowing the piston to translate or otherwise move within said passageway 154 (FIG. 2).

Figure 4:
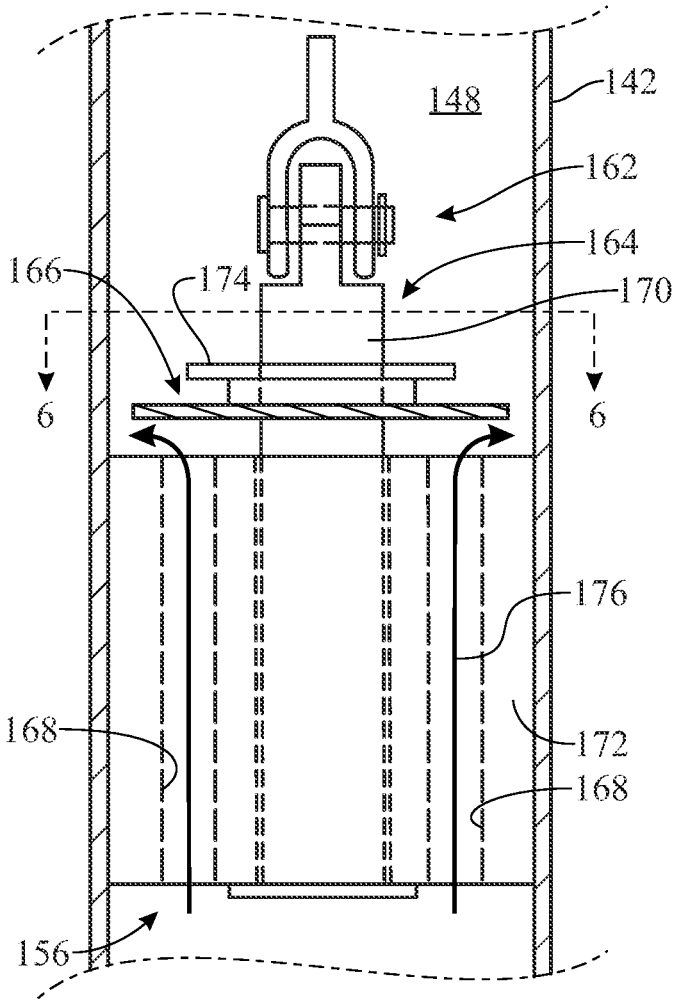
FIG. 4 presents a view of the interior of the cylinder of the braking system with the valve of the piston that traverses the passageway of the cylinder in an open position to allow airflow to pass through the piston's airflow passageway.
Figure 5:
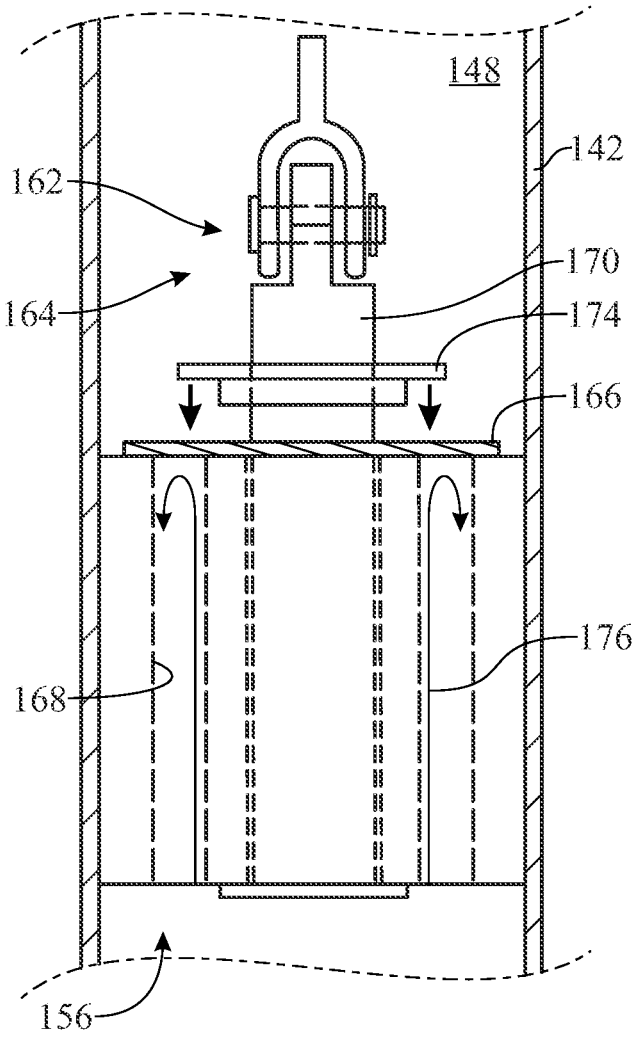
FIG. 5 presents a view of the interior of the cylinder of the braking system with the valve of the piston that traverses the passageway of the cylinder in a closed position to prevent airflow from passing through the piston's airflow passageway.
Figure 6:
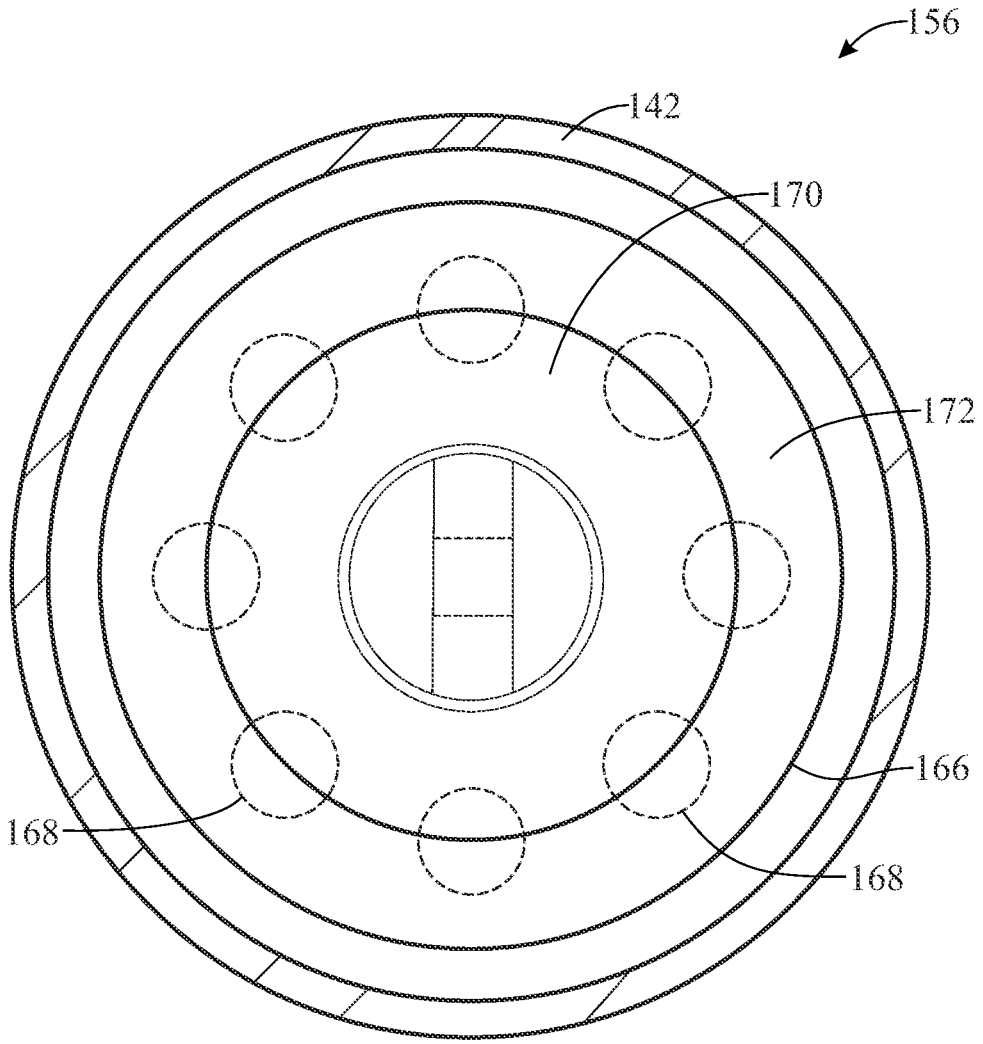
FIG. 6 presents a cross-sectional view taken across section line 6-6 shown in FIG. 4, showing a top cross-cut view of the piston.

With reference now to FIGS. 1 through 6, each cylinder 142 of the braking assembly 140 of the amusement ride encased by the vertical structure 102 includes an airflow system that generally includes a plurality of openings 150 near the bottom portion of the cylinder 142 where it has its open end 146 and the piston 156 traveling within the passageway 148. Turning now to FIGS. 4 through 6 specifically, the unique design of the piston 156 of the braking assembly 140 generally comprises a coupling head 164 connected to a central support column 170, a piston body 172 that includes a plurality of through-holes or airflow passageways 168 that allow air to flow 176, a stop plate 174, and a valve 166. As shown in the figures, the airflow passageways 168 are spaced-apart apertures on the main body 172 of the piston 156 and circularly positioned around the support column 170. All of the airflow passageways can be covered and sealed off by the valve 166 to prevent any airflow from escaping through the top portion of the piston, as seen in FIG. 5.

Returning to FIGS. 1 through 5, in operational use, an end-user 110 wears the wearable harness 108 and is taken to a launchpad, typically right underneath the support member 112. Using the webbings 122 or rope or any other secure means of attachment, the harness 108 worn by the end-user 110 is secured to the anchors 116 on the bottom portion 114 of the support member 112. The lifting cable 134, if not already lowered, is lowered toward a central anchor 120 on the top portion 118 of the support member. The lifting cable 134 is coupled to the anchor 120 on the support member through a release mechanism 136 that includes the release cord 138. The release cord 138 is always within arms reach of the end-user.

As explained above, the support member 112 is secured to the braking assembly 140 through the pair of braking cables 184. Once all of the mechanical connections are inspected for security, the lifting device 130 is activated and the lifting cable 134 moves in the direction 128 of the lifting device 130. As the end-user 110 climbs in altitude, the pistons 156 within each cylinder 142 begin to drop, as is best seen in FIGS. 1 and 2. As the pistons 156 move down from the heights point in the passageway 148 of the cylinder near the top end 144, the valve 166 of the piston is in an open position and making contact with stopper 174 (FIG. 4). This allows for airflow 176 to pass through the airflow passageways 168 within the body 172 of the piston and prevent a vacuum from occurring while the piston travels downwardly within the passageway 148. Otherwise, if a vacuum were to occur, the piston would get suck, and the braking assembly could fail.

The pistons 156 and end-user and lifting assembly combination have an inverse relationship. For instance, as the end-user 110 and the support member 112 holding the end-user climbs in height aided by the lifting device 130, the pistons 156 moves in the opposite direction within the passageway. As shown in FIG. 2, when the end-user is at the heights point possible offered by the ride, the pistons are at their lowest possible point within passageway 154 of the support frames 152 supporting the cylinders 142. Once the end-user 110 is at a maximum height, the end-user 110 can pull on the release cord 138 to activate the release mechanism 136 that will decouple the lift cable 134 suspending the end-user from the support member 112, and induce a free-fall experience.

With reference to FIGS. 2, 3 and 5, the openings in cylinder 142 within the passageway 148 generally create a pressure zone, and the available space above the openings generally creates a compression zone 158. As the end-user 110 begins to fall after engaging the release mechanism 136, the pressure zone that includes the plurality of spaced-apart openings 150 allow air to leak out of the system as the piston 156 begins to speed in the upward direction as the end-user travels in the downward direction. When the piston 156 is moving in the upward direction within the passageway 148, the valve 166, as seen in FIG. 5, is fully closed to help produce pressure within the tube as the piston travels upwardly. The openings 150 in the cylinder lessen in number or size to allow for a gradual increase of pressure to build as the piston rapidly travels upwardly toward the compression zone 158 of the cylinder with a final bleed-off opening 163 proximate the top of the cylinder 142. The final descent of the end-user 110 is smooth and can be controlled by the bleed-off opening 163. Without that gradual build-up of pressure provided by the openings 150 on cylinder 142, and the final bleed-off of pressure by opening 163, the end-user 110 could feel an uncomfortable jolt that may hurt the end-user 110 as the piston builds pressure within the passageway of the cylinder when rapidly traveling in the upward direction to stop the fall of the end-user. Instead, the variation of pressure zone 160 and compression zone 158 offered by the braking assembly 140 of the ride 100, allows the end-user first to feel a sudden free-fall experience when pulling on the release mechanism before being gradually stopped by the breaking assembly 140 before reaching the surface 104.

In summary, the invention is scalable to allow for multiple end-users to partake in the amusement ride at the same time. Each end-user can unilaterally control their own release mechanism to induce the free-fall experience. This control may also add a competitive aspect to the ride and allow multiple participants to challenge one another to achieve maximum height before activating the release mechanism. As iterated above, the amusement ride also includes an airflow system that allows air to flow through the piston having a unique valve design, which closes as the piston ascends to compress air within the cylinder and opens as the piston descends to prevent the creation of a vacuum within the piston. The Braking system also includes pressure leak-off openings that are spaced apart and fashioned about the cylinder to gradually build pressure as the piston passes each opening and reaches the compression zone of the cylinder. While the present invention includes two-cylinder, piston, and cable assemblies for safety redundancies, the amusement ride may be complete with at least one assembly. The unique design of the amusement ride does not use forced air from an outside source to control the movement of the piston. Instead, the mechanics of the piston and cylinder are manipulated through the participant's weight and gravity to produce the pressure necessary to control the descent of the end-user. The invention also allows an end-user to hang freely in a harness for as long as the end-user desires before deciding to pull on the release mechanism.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. An apparatus for invoking a free-fall experience, comprising:

a vertical structure including a plurality of structural members to provide structural integrity, wherein the vertical structure is securable to a level surface;

a lifting assembly for lifting an end-user a vertical distance away from the level surface and positioning an end-user in a free-fall position; and a braking assembly for slowing the end-user fall speed when falling from the free-fall position and bringing the end-user to a full stop before the end-user reaches the level surface, wherein the lifting assembly, comprises:

a lift assembly confined within the vertical structure for positioning an end-user in the free-fall position, the lift mechanism including a lifting device securable to the level surface, a plurality of anchored pulleys anchored to an upper portion of the vertical structure, and at least one lifting cable extending from the lifting device through the anchored pulleys and selectively engageable to a wearable body harness donned by the end-user.

2. The apparatus of claim 1, wherein the lifting assembly includes a wearable body harness assembly for securing an end-user to the lifting assembly, comprising:

a body harness;

a support member positioned normal to the elative vertical standing position of the end-user; and at least one harness webbing, the webbing including a first end removably attachable to a portion of the body harness and a second end securably attached to the support member for securing the wearable body harness to the support member of the lifting assembly.

3. The apparatus of claim 2, wherein the support member includes a pair of anchors at opposite ends of the support member about a bottom end portion, and a plurality of spaced-apart anchor members about a top portion.

4. The apparatus of claim 1, wherein the lifting device is capable of winding the lifting cable when attached to the wearable body harness to effectively position the end-user in the free-fall position.

5. The apparatus of claim 1, wherein the free-fall position is at least 10 feet above the level surface.

6. The apparatus of claim 1, wherein the braking assembly, comprises:

at least one cylinder body extending vertically within the vertical structure having an open end and a closed-end that includes a minimal opening;

a support frame supporting the cylinder body and securable to the level surface;

at least one weighted member slidable within an interior of the cylinder body;

a plurality of pulleys anchored to the vertical structure; and at least one braking cable attachable to and extending from the weighted member, wherein the cable extends through the minimal opening and engages the plurality of pulleys and secured to a wearable harness donned by the end.

7. The apparatus of claim 6, wherein the cylinder body includes a plurality of spaced-apart apertures about a bottom portion of the cylinder body proximate to where the support frame attaches to the cylinder body.

8. The apparatus of claim 7, wherein the apertures provided build pressure inside of the cylinder as the weighted member slides upwardly within the cylinder body.

9. The apparatus of claim 6, wherein the weighted member of the braking assembly includes at least one air channel and a plate valve that opens and closes depending on directional air flow traveling through the air channel.

10. The apparatus of claim 1, wherein the lift assembly includes a winch for positioning the end-user in the free-fall position.

11. The apparatus of claim 1, wherein the lifting assembly includes a releasable mechanism selectively engageable by an end-user when in the free-fall position to initiate a free-fall experience, the releasable mechanism disengaging a lifting cable coupled to a wearable harness donned by the end-user to initiate the free-fall experience.

12. An apparatus for invoking a free-fall experience, comprising:

a vertical structure including a plurality of structural members to provide structural integrity, wherein the vertical structure is securable to a level surface;

a lifting assembly for lifting an end-user from the level surface, positioning an end-user in a free-fall position, the lifting assembly including a releasable mechanism selectively engageable by an end-user when in the free-fall position to initiate a free-fall experience, wherein the free-fall position is a distance above the level surface; and a braking assembly for slowing the end-user fall speed when falling from the free-fall position and bringing the end-user to a full stop before the end-user reaches the level surface, wherein the lifting assembly, comprises:

a lift assembly confined within the vertical structure for positioning an end-user in the free-fall position, the lift mechanism including a lifting device securable to the level surface, a plurality of anchored pulleys anchored to an upper portion of the vertical structure, and at least one lifting cable extending from the lifting, device through the anchored pulleys and selectively engageable to a wearable body harness donned by the end-user.

13. The apparatus of claim 12, wherein the lifting assembly includes a wearable body harness assembly for securing an end-user to the lifting assembly, comprising:

a body harness;

a support member positioned normal to the relative vertical position of the end-user; and at least one harness webbing, the webbing including a first end removably attachable to a portion of the body harness and a second end securably attached to the support member for securing the wearable body harness to the support member of the lifting assembly.

14. The apparatus of claim 12, wherein the braking assembly, comprises:

at least one cylinder body extending vertically within the vertical structure having an open end and a closed-end that includes a minimal opening;

a support frame supporting the cylinder body and securable to the level surface;

at least one weighted member slidable within an interior of the cylinder body;

a plurality of pulleys anchored to the vertical structure; and at least one cable attachable to and extending from the weighted member through the minimal opening, engaging the plurality of pulleys and secured to a wearable harness donned by the end.

15. The apparatus of claim 14, wherein the weighted member of the braking assembly includes a plurality of air channels and a plate valve that opens and closes depending on directional air flow traveling through the plurality of air channels.

16. The apparatus of claim 12, wherein the lifting device is capable of winding the lifting cable when attached to the wearable body harness to effectively position the end-user in the free-fall position.

17. The apparatus of claim 16, wherein the lifting device comprises an electrical winch for positioning the end-user in the free-fall position.

18. An apparatus for invoking a free-fall experience, comprising:

a vertical structure including a plurality of structural members to provide structural integrity, wherein the vertical structure is securable to a level surface;

a lifting assembly for lifting an end-user a vertical distance away from the level surface and positioning an end-user in a free-fall position; and a braking assembly for slowing the end-user fall speed when falling from the free-fall position and bringing the end-user to a full stop before the end-user reaches the level surface, wherein the lifting assembly includes a wearable body harness assembly for securing an end-user to the lifting assembly, comprising:

a body harness;

a support member positioned normal to the relative vertical standing position of the end-user; and at least one harness webbing, the webbing including a first end removably attachable to a portion of the body harness and a second end securably attached to the support member for securing the wearable body harness to the support member of the lifting assembly.

19. The apparatus of claim 18, wherein the support member includes a pair of anchors at opposite ends of the support member about a bottom end portion, and a plurality of spaced-apart anchor members about a top portion.

20. The apparatus of claim 18, wherein the lifting assembly includes a releasable mechanism selectively engageable by an end-user when in the free-fall position to initiate a free-fall experience, the releasable mechanism disengaging a lifting cable coupled to a wearable harness donned by the end-user to initiate the free-fall experience.

* * * * *